US006467493B1

(12) United States Patent
Eisold

(10) Patent No.: US 6,467,493 B1
(45) Date of Patent: Oct. 22, 2002

(54) APPARATUS FOR WASHING AND CLEANING DIRTY ROLLER BEARINGS

(76) Inventor: Volkmar Eisold, Kretschmer Str. 21, D-07549, Gera (DE)

( * ) Notice: Subject to any disclaimer, the term of this patent is extended or adjusted under 35 U.S.C. 154(b) by 0 days.

(21) Appl. No.: 09/558,783

(22) Filed: Apr. 26, 2000

(30) Foreign Application Priority Data

Apr. 29, 1999 (DE) ..... 199 19 507

(51) Int. Cl.[7] ..... B08B 3/00

(52) U.S. Cl. ..... 134/158; 134/161; 134/162; 134/184

(58) Field of Search ..... 134/79, 85, 87, 134/92, 137, 138, 142, 147, 149, 150, 157, 158, 159, 161, 162, 184, 201

(56) References Cited

U.S. PATENT DOCUMENTS

| | | | | | |
|---|---|---|---|---|---|
| 1,443,803 | A | * | 1/1923 | Reatherford | 134/142 |
| 1,753,462 | A | * | 4/1930 | Geery | 134/121 |
| 2,277,919 | A | * | 3/1942 | Liptak | 141/1 |
| 2,652,350 | A | * | 9/1953 | Dailey | 134/23 |
| 2,652,843 | A | * | 9/1953 | Schuchman et al. | 134/116 |
| 2,823,682 | A | * | 2/1958 | Coulter | 134/94 |
| 3,886,958 | A | | 6/1975 | Diebel et al. | 134/80 |
| 4,757,831 | A | * | 7/1988 | Ingermann et al. | 134/148 |
| 5,297,569 | A | * | 3/1994 | McLain | 134/143 |
| 5,678,582 | A | * | 10/1997 | McLure | 134/116 |
| 5,863,350 | A | * | 1/1999 | Lekavich | 134/116 |
| 6,058,948 | A | * | 5/2000 | Wershe | 134/117 |

FOREIGN PATENT DOCUMENTS

| | | |
|---|---|---|
| DE | 3301968 | 8/1984 |
| DE | 220876 A1 | 4/1985 |
| DE | 19728046 | 1/1999 |

* cited by examiner

*Primary Examiner*—Randy Gulakowski
*Assistant Examiner*—Joseph Perrin
(74) *Attorney, Agent, or Firm*—Jordan and Hamburg LLP

(57) ABSTRACT

An apparatus for cleaning dirty roller bearings having inner and outer rings finds particular applicability for on the spot washing of bearings used on sports and leisure equipment such as, for example, skateboards and inline skates, after being dismantled from the equipment. A circular head plate is receivable on a container for containing a volume of cleaning fluid. Accommodating axes are disposed circularly on the head plate for accommodating the roller bearings that arc to be cleaned, with the inner rings of the roller bearings in frictional contact therewith. A drive shaft including an external hand wheel is rotatably connected through the head plate to permit rotation of the drive shaft relative to the head plate and the accommodating axes when the hand wheel is turned. The accommodating axes and the roller bearings mounted thereon are rotatable with the outer rings roller bearings in frictional contact with drive shaft immersed in the cleaning fluid, whereby the inner and outer rings of the roller bearings are made to rotate by rotation of the drive shaft.

14 Claims, 1 Drawing Sheet

APPARATUS FOR WASHING AND CLEANING DIRTY ROLLER BEARINGS

BACKGROUND OF THE INVENTION

The field of application of the invention lies, in particular, in the sport and leisure area where dirty roller bearings, which are integrated into sport and leisure equipment, such as skateboards and/or inline skates, are to be washed and cleaned on the spot by the sports or equipment manager or also by the support point leader with the help of this apparatus without great effort.

The inventive apparatus can also be used in the service sector of workshops or service support points.

Apparatuses and methods for washing and cleaning as well as preserving of roller bearings are known.

For example, in the DD 2 20 876, conveying equipment is described, especially for roller bearings for passing through washing and preserving equipment and, in the DE 33 01 968, a method is described with an apparatus for effectively washing roller bearings. In the U.S. Pat. No. 3,868,958, an apparatus is described for washing and cleaning roller bearings, which lie on a grating and are sprayed with cleaning fluid.

The disadvantage of these solutions consists therein that they are tied exclusively into the manufacturing lines for producing roller bearings and are intended for cleaning and preserving newly produced roller bearings.

A further disadvantage consists therein that, during the washing and cleaning processes, the roller bearings are moved only in the specified direction of rotation (left or right).

In the DE 197 280 46, a manual apparatus for cleaning dirty roller bearings is described.

The disadvantage of this apparatus consists therein that it is possible to accommodate the roller bearings, which are to be cleaned only next to one another and, as a result, the size is determined by the number of accommodating mandrels. In practice, this means that the apparatus almost exclusively has larger dimensions and thus is less suitable for portable use.

SUMMARY OF THE INVENTION

It is an object of the invention to provide a convenient apparatus which, because of its dimensions and weight, can easily be transported, for washing and cleaning roller bearings and which permits several roller bearings of the same type and size, which have already been used, to be freed without great effort from dirt, such as sand, dust, oil, moisture and no longer usable lubricants.

At the same time, it shall be possible to change the direction of rotation of the roller bearings during the cleaning process.

Pursuant to the invention, this objective is accomplished owing to the fact that the dirty roller bearings, after they are dismantled from the sport and leisure equipment, are slipped one above the other onto accommodating axes and fastened. Several such accommodating axes are disposed circularly on a circular head plate.

The head plate and cleaning fluid are placed in an also circular container, having a volumetric capacity of about 350 ml. The driving shaft is caused to rotate by means of the external hand wheel and the dirt particles or contaminations are removed from the roller bearings by the forced rotation of the dirty roller bearings in the cleaning fluid and passed centrifugally to the end wall of the container and deposited there.

By manually changing the direction of rotation of the hand wheel of the driving shaft repeatedly, the washing and cleaning effect is increased significantly.

The special advantages of the inventive apparatus consist therein that, because of their small size and low weight, as well as the manually operated construction, it is portable and can be used everywhere. At the same time, several, for example, 20 roller bearings simultaneously can be moved in the cleaning fluid in both directions and cleaned.

The invention is described in greater detail by means of the example, shown in the drawing, in which.

DETAILED DESCRIPTION OF THE PREFERRED EMBODIMENT

Figure 1:
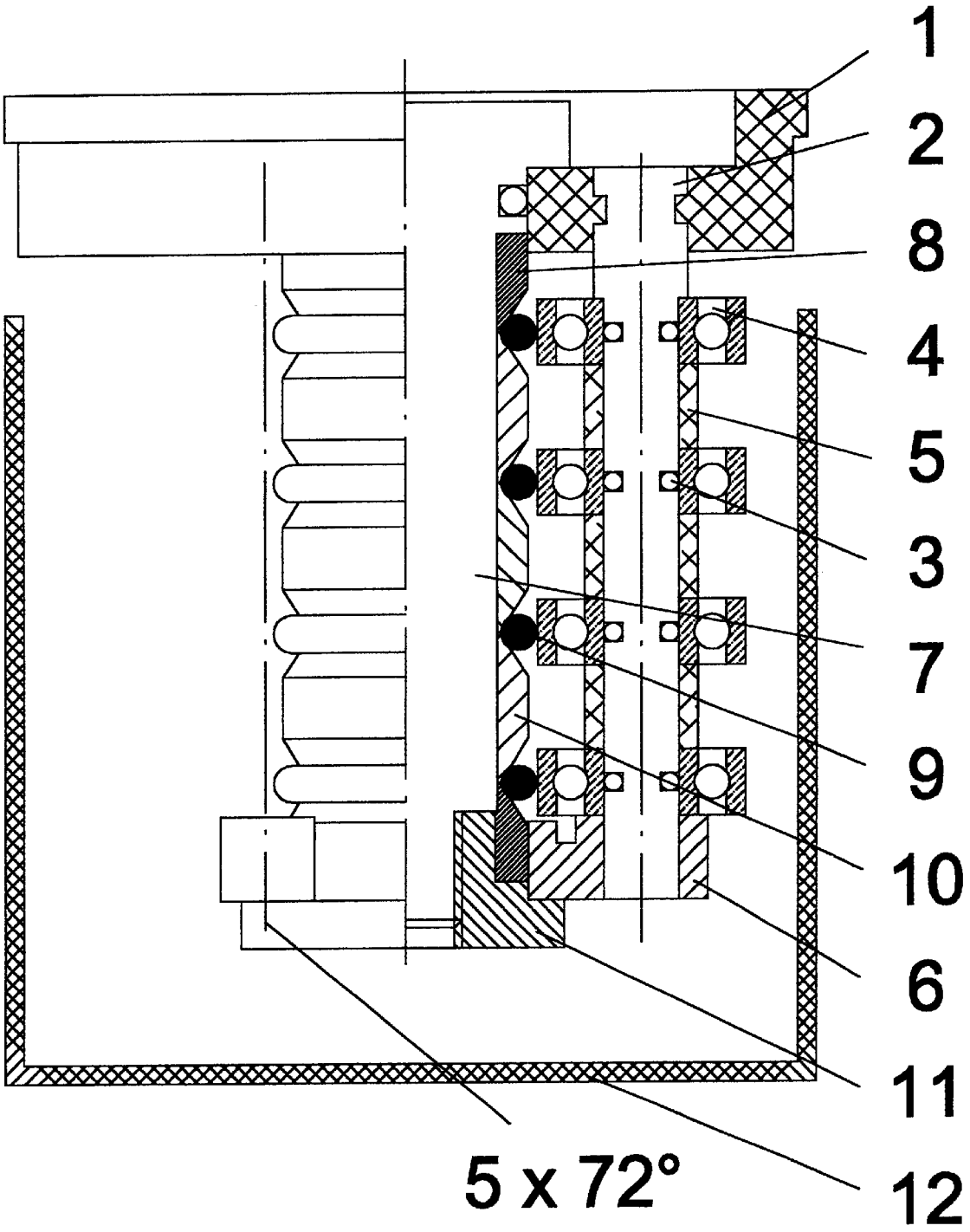
FIG. 1 shows a diagrammatic construction of the cleaning apparatus; the representation is not to scale.

The apparatus consists of the circular head plate 1, which is set down on its underside. At the same time, it forms the cover for the circular container 12, in order to avoid spraying the cleaning fluid during the washing process.

Five accommodating axes 2 are fastened to the plastic head plate 1 by injection. The drive shaft 7 and the hand wheel are produced from one piece. An O-ring 9, which functions as a seal towards the outside, is installed in the recess on the drive shaft 7. After that, the drive shaft 7 is inserted through the central borehole of the head plate 1 and equipped as follows: a spacer 8, an O-ring 9, a spacer 10, an O-ring 9, a spacer 10, an O-ring 9, a spacer 10, an O-ring 9 and finally, once again, a spacer 8.

In the recesses on the five accommodating axes 2, O-rings 3 are installed, which hold the inner ring of the roller bearings 4 by friction. The accommodating axes 2 are now equipped as follows: a roller bearing 4, a spacer 5, a roller bearing 4, spacers 5, a roller bearing 4, a spacer 5 and roller bearing 4. The spacers 5 keep the roller bearings 4 apart, so that cleaning liquid can be flushed around them and contamination can escape.

When all five accommodating axes 2 are fully equipped, the accommodating plate 6 is put into place. The latter is provided with five 5×72° boreholes for accommodating axes 2 and with a central borehole for the drive shaft 7. The accommodating plate 6 holds the roller bearings 4 and She accommodating axes 2, in order to avoid that the latter are displaced towards the outside when the screw 11 and the spacers 8 and 10 are screwed down onto the drive shaft 7.

The spacers 8 and 10 and the drive shaft 7 are screwed together with the screw 11. At the same time, the O-rings 9 are expanded by the inclined surfaces at the spacers 8 and 10 and contact the outer ring of the roller bearings 4 with friction. By these means, rotation of the outer ring of the roller bearing 4 is ensured.

The now completely assembled head plate 1 is placed in the 350 ml container 12 together with the cleaning fluid and, moreover, in such a manner that all roller bearings 4 are immersed in this fluid.

The actual washing and cleaning process takes places as follows:

When the external hand wheel of the drive shaft 7 is moved alternately in one of the two directions of rotation (left or right), this is moved in the opposite direction over the O-ring 9, which is in contact with the outer ring. Since the outer ring of the roller bearings and the ball bearing cage also move in opposite directions to one another, the parts of the roller bearing 4, which are to be cleaned, move in the cleaning fluid. By changing the direction of rotation, the cleaning fluid is flushed well all around the roller bearing.

What is claimed is:

1. An apparatus for washing and cleaning dirty roller bearings having inner and outer rings, comprising:

a container for containing a volume of cleaning fluid;

a circular head plate receivable on said container for covering said container;

accommodating axes disposed circularly on said circular head plate for accommodating the roller bearings that are to be cleaned with the inner rings of the roller bearings in frictional contact therewith; and a drive shaft including an external hand wheel rotatably connected through said head plate to permit rotation of said drive shaft relative to said head plate and said accommodating axes when said hand wheel is turned, said accommodating axes and the roller bearings mounted thereon being rotatable with the outer rings of the roller bearings in frictional contact with said drive shaft immersed in the cleaning fluid, whereby the inner and outer rings of the roller bearings are made to rotate by rotation of said drive shaft.

2. The apparatus according to claim 1, wherein for the cleaning the head plate, equipped with roller bearings, is seated inside the container with the cleaning fluid.

3. The apparatus according to claim 1 or 2, wherein for manually moving the head plate with the dirty roller bearings disposed on the accommodating axes through the cleaning fluid, a drive shaft with mounted hand wheel is disposed on the head plate.

4. An apparatus for washing roller bearings having concentric inner and outer rings, comprising:

a container for containing a volume of cleaning fluid;

a head plate receivable on said container for covering said container;

accommodating axes disposed circularly on said head plate for accommodating the roller bearings that are to be washed; said accommodating axes being in frictional contact with the inner rings of the roller bearings when received thereon;

a centrally located rotatable drive shaft extending codirectionally with said accommodating axes, the outer rings of the roller bearings being in frictional contact with at least structural portions of said drive shaft when the roller bearings are received on said accommodating axes; and means for imparting rotation to said drive shaft, whereby rotation of said drive shaft rotates inner rings of the roller bearings relative to the outer rings thereof.

5. The apparatus according to claim 4, wherein said means for imparting rotation includes hand-operable structure located external of said container.

6. The apparatus according to claim 5, wherein said means for imparting rotation is operable to apply rotation to said drive shaft in two directions.

7. The apparatus according to claim 6, wherein said hand-operable structure communicates with said drive shaft across said head plate via an opening provided therein.

8. The apparatus according to claim 7, wherein said hand-operable structure is a hand wheel formed integrally with said drive shaft.

9. The apparatus according to claim 4, wherein said container has a volume of approximately 350 ml.

10. The apparatus according to claim 4, wherein said drive shaft includes radially formed recesses spaced apart along a longitudinal extent of said drive shaft, and O-rings accommodated in said recesses, said O-rings comprising said at least structural portions of said drive shaft which are in frictional contact with the outer rings of the roller bearings.

11. The apparatus according to claim 10, wherein said drive shaft includes a central axle and stackable spacers receivable on said central axle, edge regions of said spacers defining the recesses when stacked.

12. The apparatus according to claim 11, farther comprising a retaining screw threadably engageable with an end of the central axle of the drive shaft for captively retaining the spacers received on the central-axle.

13. The apparatus according to claim 4, wherein said accommodating axes include radially formed recesses, and O-rings accommodated in said recesses arranged to frictionally contact the inner rings of the roller bearings.

14. The apparatus according to claim 4, further comprising annular bearing spacers receivable about said accommodating axes, said bearing spacers having an outer diameter which is larger than an inner diameter of each of said inner rings such that by interspersing said bearing spacers and the roller bearings on the accommodating axes, the roller bearings are maintained in a spaced apart relationship to one another along said accommodating axes.

* * * * *